United States Patent [19]

Haack

[11] 4,396,226

[45] Aug. 2, 1983

[54] STRUCTURAL COMPONENT ASSEMBLY FOR UPHOLSTERED FURNITURE AND METHOD OF MAKING

[75] Inventor: Dennis A. Haack, Troy, Ohio

[73] Assignee: Denack Design Corporation, Troy, Ohio

[21] Appl. No.: 203,561

[22] Filed: Nov. 5, 1980

Related U.S. Application Data

[63] Continuation-in-part of Ser. No. 75,449, Sep. 14, 1979, Pat. No. 4,298,964.

[51] Int. Cl.[3] ..... A47C 27/00

[52] U.S. Cl. ..... 297/218; 5/402; 5/404; 5/406; 297/443; 297/452

[58] Field of Search ..... 5/402, 403, 404, 405, 5/406, 407, 411; 297/218, 219, 443, 444, 452

[56] References Cited

U.S. PATENT DOCUMENTS

| | | | |
|---|---|---|---|
| 1,524,045 | 1/1925 | Lichter . | |
| 1,756,579 | 4/1930 | Wisner . | |
| 2,096,822 | 10/1937 | Oldham | 5/402 |
| 2,178,670 | 11/1939 | Menge . | |
| 2,567,550 | 9/1951 | Clark et al. | 5/402 |
| 2,609,036 | 9/1952 | Stubnitz | 5/402 |
| 2,760,562 | 8/1956 | Fisher | 5/402 |
| 2,878,861 | 3/1959 | Molla . | |
| 3,084,739 | 4/1963 | Jaworski . | |
| 3,125,156 | 3/1964 | Grimshaw . | |
| 3,423,775 | 1/1969 | Cockerill | 5/404 |
| 3,630,572 | 12/1971 | Homier . | |
| 3,871,041 | 3/1975 | Plume | 5/402 |
| 3,904,242 | 9/1975 | Koepke et al. . | |
| 3,928,898 | 12/1975 | Smoot | 5/404 X |
| 3,981,534 | 9/1976 | Wilton . | |
| 4,332,419 | 1/1983 | Vogel | 297/443 |

FOREIGN PATENT DOCUMENTS

| | | | |
|---|---|---|---|
| 1285139 | 12/1968 | Fed. Rep. of Germany | 5/402 |
| 162575 | 3/1958 | Sweden | 5/406 |

*Primary Examiner*—James T. McCall
*Attorney, Agent, or Firm*—Jacox & Meckstroth

[57] ABSTRACT

A structural component for upholstered furniture includes a three-dimensional frame consisting of a plurality of wires which are welded together. A flexible substrate sheet and an upholstery material cover are secured together with padding held between the substrate sheet and the cover. Clips either pierce the substrate sheet or are attached to the cover and engage the border frame wires such that the upholstery is fastened to the frame. Preferably, the clips comprise extruded plastic elongated strip members having flange portions which are stitched to the material cover and snap portions which snap-fit onto the border wires.

20 Claims, 20 Drawing Figures

FIG-14
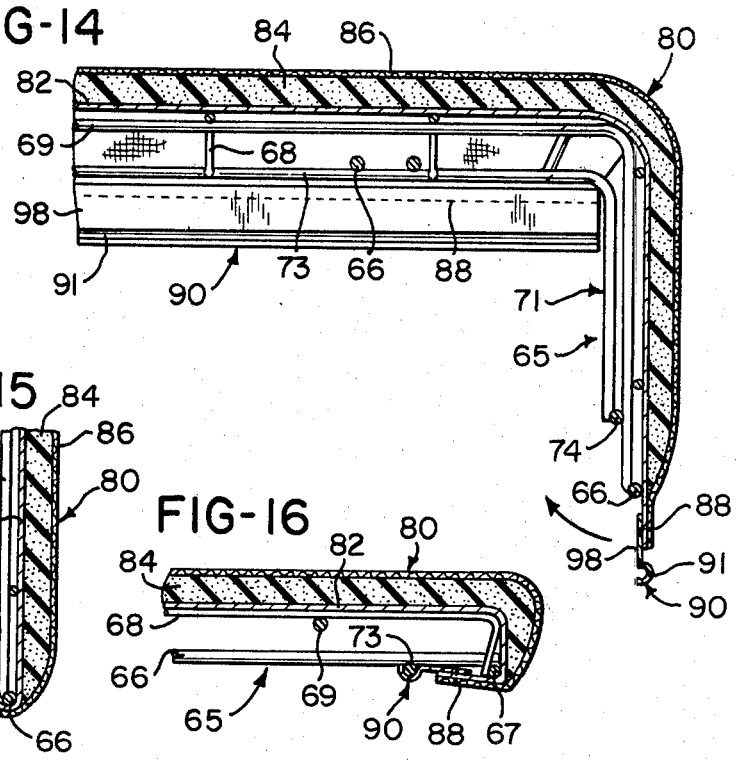
FIG-15
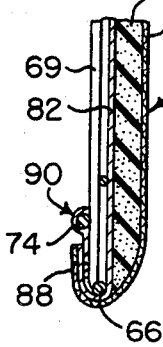
FIG-16
FIG-17
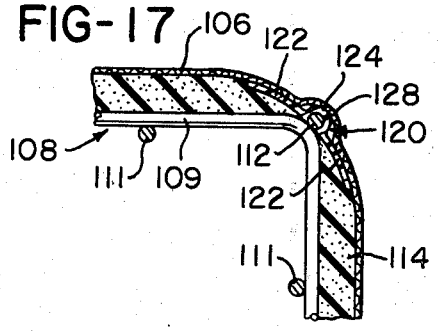
FIG-18
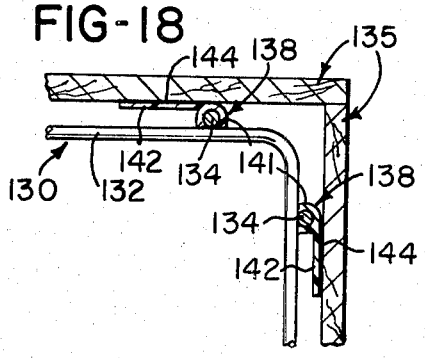
FIG-19
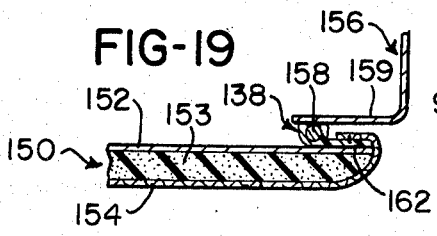
FIG-20
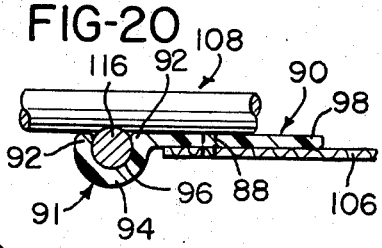

STRUCTURAL COMPONENT ASSEMBLY FOR UPHOLSTERED FURNITURE AND METHOD OF MAKING

RELATED APPLICATION

This application is a continuation-in-part of application Ser. No. 075,449, filed Sept. 14, 1979, now U.S. Pat. No. 4,296,964.

BACKGROUND OF THE INVENTION

The present invention relates to a structural component assembly for upholstered furniture and, more particularly, to such a component in which the padding and upholstery material is fastened over a three-dimensional wire frame by means of wire engaging clips.

Conventional construction techniques for upholstered furniture require substantial time and skill on the part of the workers fabricating the upholstered furniture. Initially, a wood frame, such as shown in U.S. Pat. No. 3,256,041, issued June 14, 1966, to Armstrong, is constructed. Thereafter, the frame may be covered with padding material, and upholstery material is stretched over the padding material and fastened to the frame to form the finished piece of furniture. Considerable time is required in order to produce a neat, finished appearance.

Additionally, since the padding is compressed substantially by the upholstery material in conventional furniture constructions, the tension to which this material is stretched prior to fastening to the wooden frame is a significant factor in the dimensions of the various portions of the finished chair. If, for instance, the fabric covering the arms of a chair is stretched too tightly, the padding material may be compressed to the point where the distance between the arms is too great. As a result, the cushion manufactured to rest on the seat of the chair may not fill the space between the arms completely.

Additional problems may also arise where the upholstery material utilized carries a pattern. If, for instance, the upholstery material is striped, it is desirable that the stripes extend in proper alignment across the various component portions of the piece of furniture. This alignment of patterns in the upholstery fabric between various components requires additional time and effort on the part of the worker assembling the piece of furniture.

The wood frame structure found in conventional upholstered furniture construction also has a number of disadvantages. First, construction of the frame is a time consuming process. Second, a wood frame is susceptible to damage as a result of high humidity. Finally, such a frame is relatively heavy.

Various approaches have been taken to improving the construction of upholstered furniture. U.S. Pat. No. 3,759,571, issued Sept. 18, 1973, to Korch, discloses an upholstered chair having a skeletal frame to which molded side arms formed of a reinforced rigid foam are secured. Pre-upholstered side arm cushions overlie the rigid foam side arms and are secured thereto. The seat construction of Korch, nevertheless, requires substantial skill on the part of the worker assembling the chair.

A wire frame chair is disclosed in U.S. Pat. No. 3,834,759, issued Sept. 10, 1974, to Panton, in which the supporting frame is composed of a plurality of substantially identical frame members, closed in themselves, and arranged in spaced relation to each other. Each of the frame members is formed of bent wire and transverse frame elements interconnect the frame members. While providing a wire frame chair which eliminates the problems associated with wood frame upholstery, the Panton concept is severely limited in the designs of the furniture which can be produced, since each of the frame members is identical in shape. Additionally, there is no suggestion in Panton of a method for upholstering the chair so produced. Rather, Panton simply suggests using cushions which overlie, and are supported by the frame.

It is seen, therefore, that there is a need for a simplified construction for upholstered furniture components in which upholstery material and padding is used to cover a supporting wire frame with the upholstery material and padding being secured to the frame in a manner requiring relative little time and skill on the part of a worker.

SUMMARY OF THE INVENTION

In accordance with one embodiment of the invention, a structural component for upholstered furniture has a three-dimensional frame consisting of a plurality of wires welded together. Upholstery means include a flexible or foldable substrate sheet, and an upholstery cover material is secured to the substrate sheet with padding means confined between the substrate sheet and said cover material. Clip means are attached to the substrate sheet and cover material and engage the wire frame, whereby the upholstery means is fastened to the frame.

The three-dimensional frame may include a first outer wire mat and a second inner wire mat welded to the outer wire mat. The frame also includes a plurality of border wires on the second wire mat for receiving the clip means. The flexible substrate sheet is of appropriate shape for covering the frame, and the padding means is adhesively mounted on the flexible substrate sheet. The upholstery cover material may be sewn to the substrate sheet adjacent the periphery thereof, and a portion of the periphery of the flexible substrate sheet may be exposed.

The clip means may each comprise a clip having a frame engaging portion piercing the flexible substrate sheet and a clip head on the opposite side of the substrate sheet from the frame engaging portion. The frame engaging portion may extend from the flexible substrate sheet on the same side thereof as the upholstery cover material. The flexible substrate sheet may be folded adjacent its periphery such that the exposed portion of the substrate sheet periphery is on the opposite side of the upholstery cover material. The folded portion of the substrate sheet is adhesively secured together to maintain the fold, with the clip heads of the clip means held within the fold.

The padding means may comprise a sheet of resilient foam material which is secured to the flexible substrate sheet by pressure-sensitive tape having adhesive on both sides thereof. The folded portion of the substrate sheet may be secured by means of a pressure-sensitive tape having adhesive on both sides thereof.

In accordance with another embodiment of the invention, the clip means comprise extruded plastic attachment strips which have flange portions attached or sewn to the peripheral edge portions of of the flexible cover material and which may also be sewn to the corresponding edge portions of the substrate sheet. Each attachment strip also includes a longitudinally extending snap portion which snap-fits onto a corresponding border wire attached to the frame. The extruded plastic attachment strip may also have flange portions projecting from both sides of the wire snap portion, or the flange portion may be located relative to the snap portion so that the flange portion may be attached or bonded to a rigid decorative panel which is to be supported by the wire frame.

Other features and advantages of the invention will be apparent from the following description, the accompanying drawings and the appended claims.

BRIEF DESCRIPTION OF THE DRAWINGS

FIG. 14 is a fragmentary section similar to FIG. 6 of an upholstery component assembly in accordance with a modification of the invention and prior to attachment of the upholstery to the wire frame;

FIGS. 15 and 16 are fragmentary sections of the assembly of FIG. 14 and illustrating the attachment of the upholstery to the wire frame;

FIG. 17 is another fragmentary section of an upholstery component assembly and illustrating a further attachment modification of the invention;

FIG. 18 is a fragmentary section illustrating the attachment of wood trim members to a wire frame in accordance with the invention;

FIG. 19 is a fragmentary section illustrating the assembly of an upholstery component to a sheet metal frame in accordance with the invention; and FIG. 20 is an enlarged fragmentary section of a wire frame and attachment of an upholstery cover material to the frame in accordance with the invention.

DETAILED DESCRIPTION OF THE PREFERRED EMBODIMENTS

Figure 1:
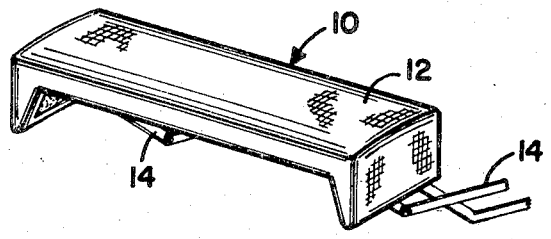
FIG. 1 is a perspective view of a structural component embodying the present invention.
Figure 2:
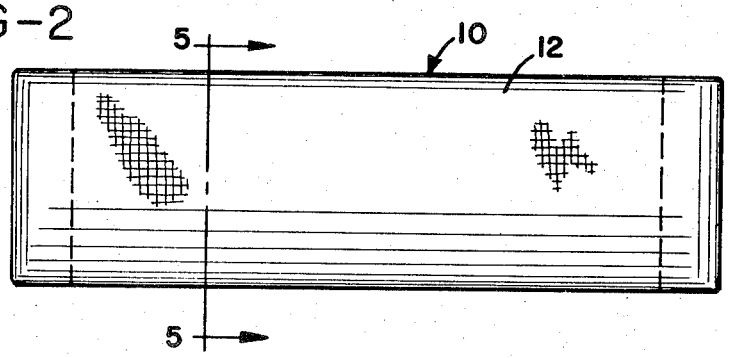
FIG. 2 is a plan view of the component of FIG. 1.
Figure 3:
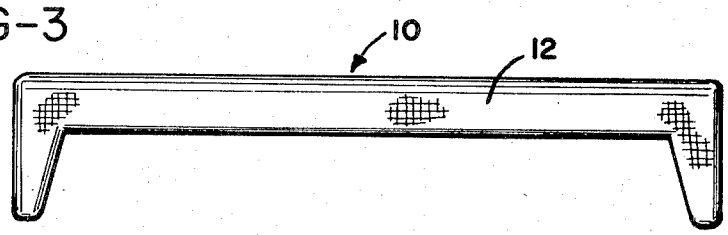
FIG. 3 is a front view of the component of FIG. 1.
Figure 4:
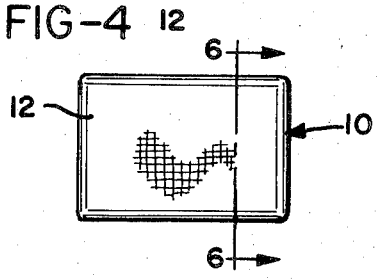
FIG. 4 is a side view of the component of FIG. 1.

Reference is made to FIGS. 1-4 which illustrate a foot rest embodying the present invention. Although a foot rest is shown and described herein, it will be appreciated by those skilled in the art that the present invention is applicable to other structural components for upholstered furniture and the like, such as chair arms and backs. As seen in FIG. 1, the foot rest 10 is covered with a cover 12 of upholstery material such as a decorative fabric or vinyl. A pantograph-type linkage arrangement 14 is secured to the bottom of the foot rest and supports the foot rest during use, as well as extending and retracting the foot rest with respect to a recliner chair to which the pantograph linkage arrangement 14 is secured.

Figure 5:
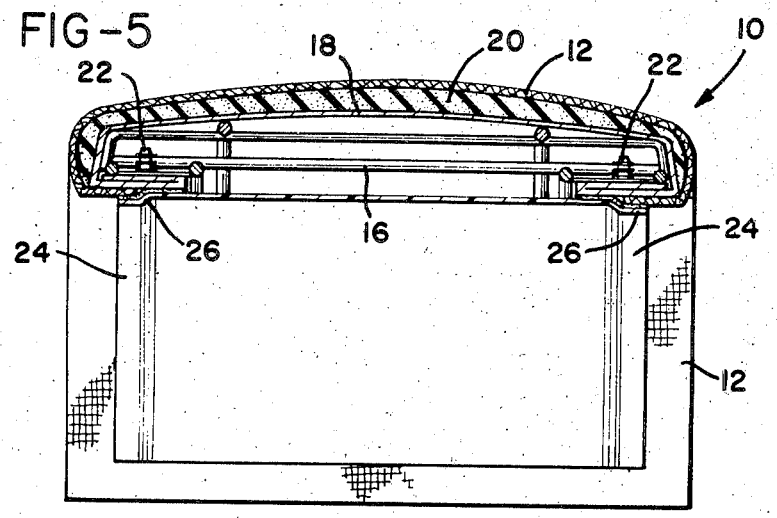
FIG. 5 is a sectional view, taken generally along line 5—5 in FIG. 2.
Figure 6:
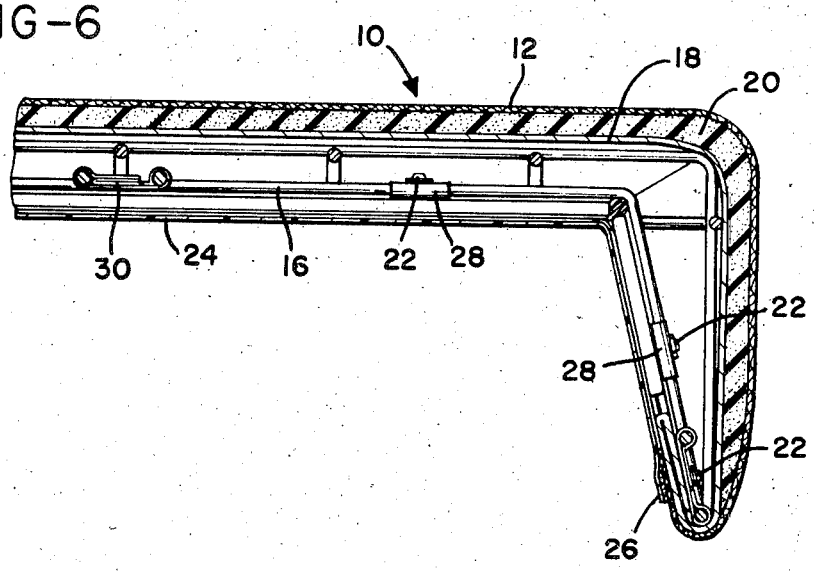
FIG. 6 is a partial sectional view, taken generally along line 6—6 in FIG. 4.

FIGS. 5 and 6 are sectional views illustrating the construction of the component of the present invention. A three-dimensional frame 16 consists of a plurality of wires which are welded together in the shape required by the structural component. The frame 16 is covered by an upholstery means which includes a flexible substrate sheet 18 and the upholstery cover 12 which is secured to the sheet 18 with padding means 20 held between the sheet 18 and the cover 12. The flexible sheet 18 may be constructed of any suitable material, such as, for example, relatively stiff cardboard. The padding means may comprise a layer of foam material, such as a foamed polymer material. Clip means including molded plastic clips 22 pierce the substrate sheet 18 and connect with the frame 16, thus fastening the upholstery means securely to the frame 16.

A bottom cover sheet 24 is secured to the bottom portion of the upholstery means by double-sided pressure-sensitive adhesive tape 26 such that the frame 16 is completely enclosed. The clip means include a plurality of clip engaging brackets 28 which are attached to the frame 16 and are appropriately positioned to be engaged by the plastic clips 22. Additionally, brackets 30 are provided on the frame 16 for engaging bolts (not shown) in ends of the pantograph linkage arrangement 14.

Figure 7:
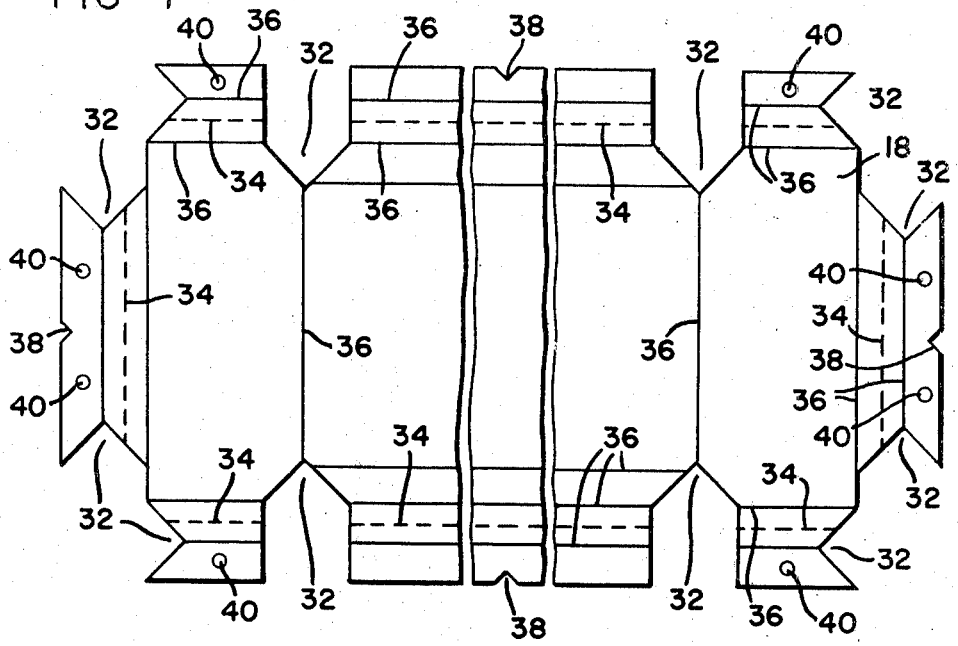
FIG. 7 is a plan view of a flexible sheet substrate with portions broken away.

FIGS. 7-10 illustrate the details of the construction of the upholstery means, including the flexible substrate sheet 18, the padding means 20, and the upholstery material cover 12. As seen in FIG. 7, the flexible substrate sheet 18 is appropriately shaped for covering the frame. A number of cutouts 32, dictated by the shape of the frame to be covered, are provided around the periphery of the substrate sheet 18 to permit the sheet to be wrapped neatly around the frame. The substrate sheet 18 also includes printed sewing lines 34 which assist a worker during an operation in which the upholstery material cover 12 is sewed to the substrate sheet 18, as described more completely below. A plurality of fold lines 36 are indicated.

The substrate sheet 18 will preferably be scored along fold lines 36 to facilitate folding of the substrate along these lines. Alignment notches 38 are also provided along the periphery of the substrate sheet 18 to assist a worker in properly aligning upholstery material which is to be sewn to the sheet 18. Notches 38 are particularly advantageous where the upholstery material includes a pattern which much be precisely aligned. The substrate sheet 18 also includes a plurality of holes 40 along its periphery which are positioned to receive clips 22 as more fully described below.

Figure 8:
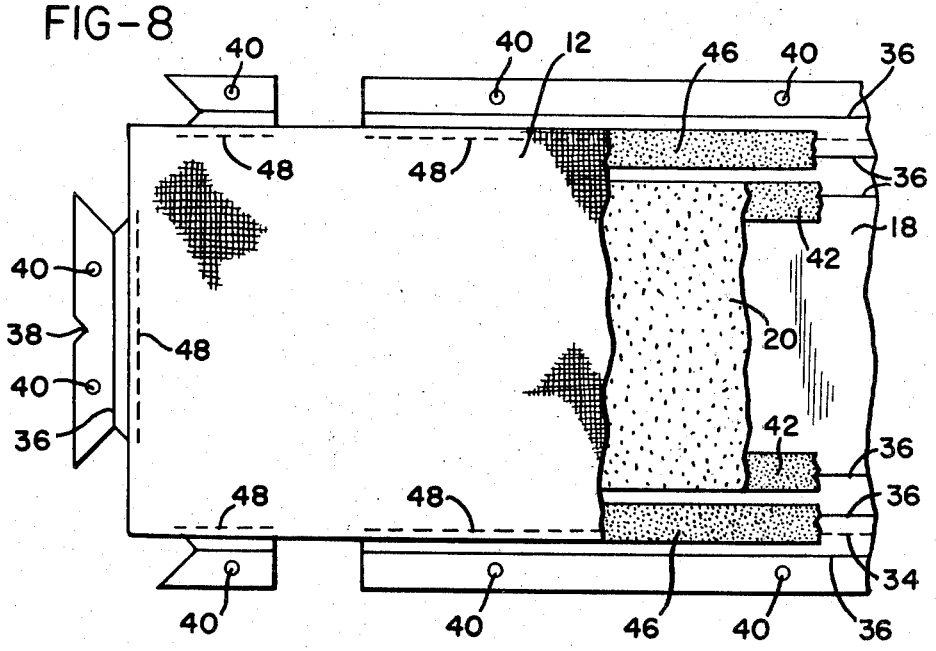
FIG. 8 is a view, similar to FIG. 7, of the left portion of the flexible sheet substrate with padding material and an upholstery material cover added.

FIG. 8 shows the upholstery means, with the padding means 20 and the upholstery material cover 12 added. Foam padding 20 is attached to substrate sheet 18 by double-sided, pressure-sensitive adhesive tape 42. Similarly, upholstery material cover 12 is also attached to the substrate sheet 18 by double-sided, pressure-sensitive adhesive tape 46. Additionally, the upholstery material cover 12 is sewn as indicated at 48, to the flexible substrate sheet 18 adjacent the periphery thereof. The upholstery material cover 12 leaves at least a portion of the periphery of the flexible substrate sheet 18 exposed.

Figure 9:
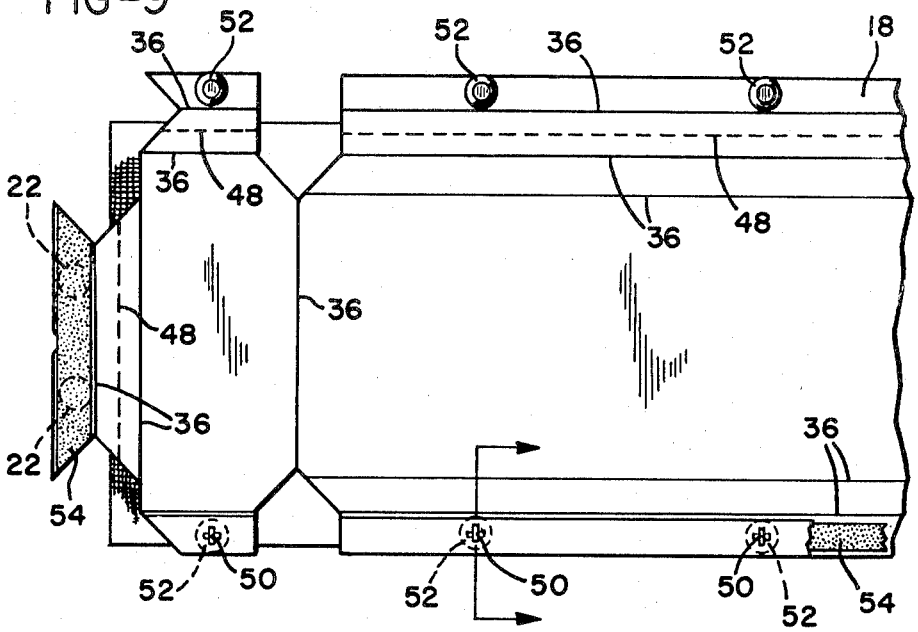
FIG. 9 is a view of the substrate, padding material, and upholstery material cover, as seen from the side opposite that shown in FIG. 8, with clip means being added.
Figure 10:
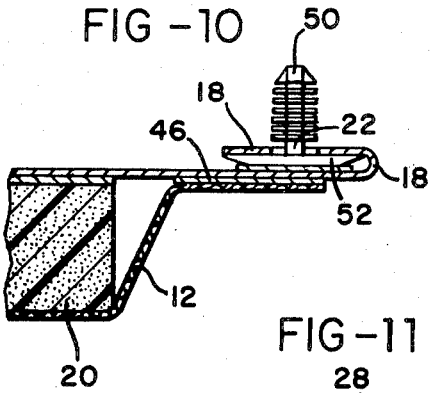
FIG. 10 is a partial enlarged sectional view taken generally along line 10—10 in FIG. 9.

FIGS. 9 and 10 illustrate the manner in which the clips 22 are added to the upholstery means prior to attachment of the upholstery mens to the frame 16. Although the clips 22 are not illustrated in FIG. 8, it should be appreciated that the clips are typically placed in holes 40 prior to the addition of the foam material 20 and the upholstery material cover 12 to the flexible substrate sheet 18. As seen in FIGS. 9 and 10, each clip comprises a frame engaging portion 50 piercing the flexible sheet 18, and a clip head 52 which is on the opposite side of the sheet 18 from the frame engaging portion 50. Since the frame engaging portions 50 of the clips 22 extend from the flexible sheet 18 on the same side thereof as the upholstery material cover 12, the clips 22 can be inserted in the sheet 18 prior to the sheet being laid on the flat support table of a sewing machine used to sew the cover 12 to the substrate sheet 18 as indicated at 48. It will be apparent that if the clips were inserted through the substrate sheet 18 in the opposite direction, the sheet would not lie flat during this sewing operation.

It will be further appreciated, however, that the construction of the structural component of the present invention, as illustrated in FIGS. 5 and 6, requires that the frame engaging portions 50 of the clips 22 extend from the upholstery means on the side opposite the upholstery material cover 12. In order to accomplish this, the substrate sheet is folded adjacent its periphery such that the exposed portion of the sheet periphery, which was not covered by the upholstery material cover 12, is on the opposite side of the upholstery means from the upholstery material cover 12. As seen in FIG. 9, a double-sided pressure-sensitive adhesive tape 54 is applied to the substrate sheet 18 over the clip heads 52, as depicted along the left hand periphery of the substrate sheet 18. Thereafter, as shown along the bottom periphery of the substrate sheet 18 in FIG. 9, the exposed portion of the sheet periphery is folded over and the folded portion is adhesively secured together to maintain the fold. The clip heads 52 are therefore held within the fold. The upholstery means may now be wrapped around the three-dimensional wire frame and secured to the border wires by the clips 22 and the brackets 28.

Figure 11:
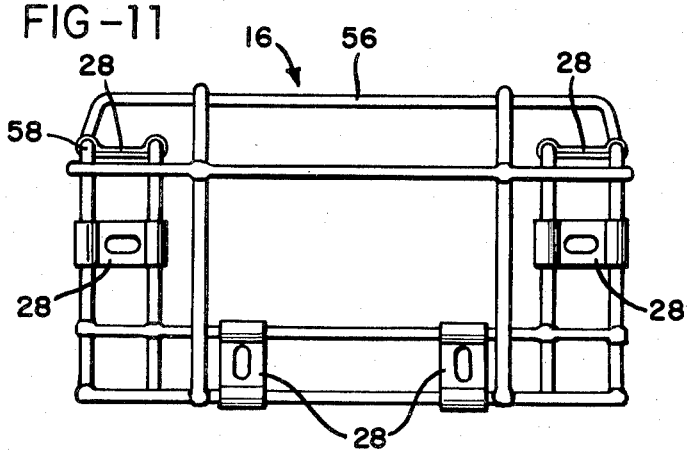
FIG. 11 is a side view of the three-dimensional frame.
Figure 12:
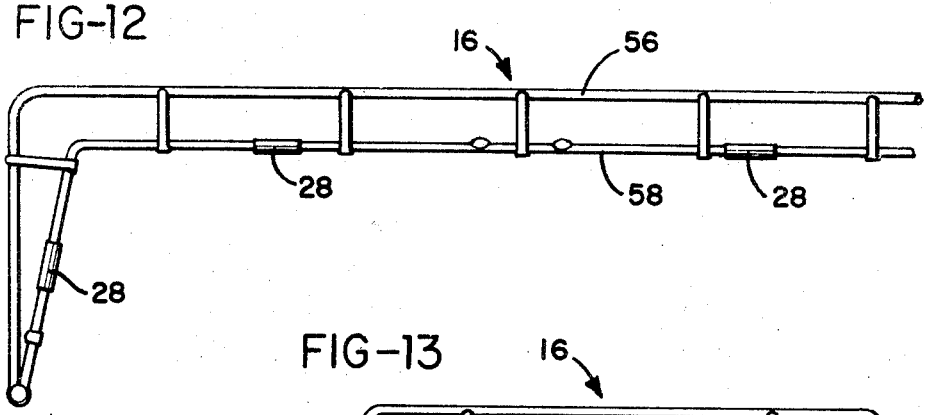
FIG. 12 is a partial front view of the three-dimensional frame.
Figure 13:
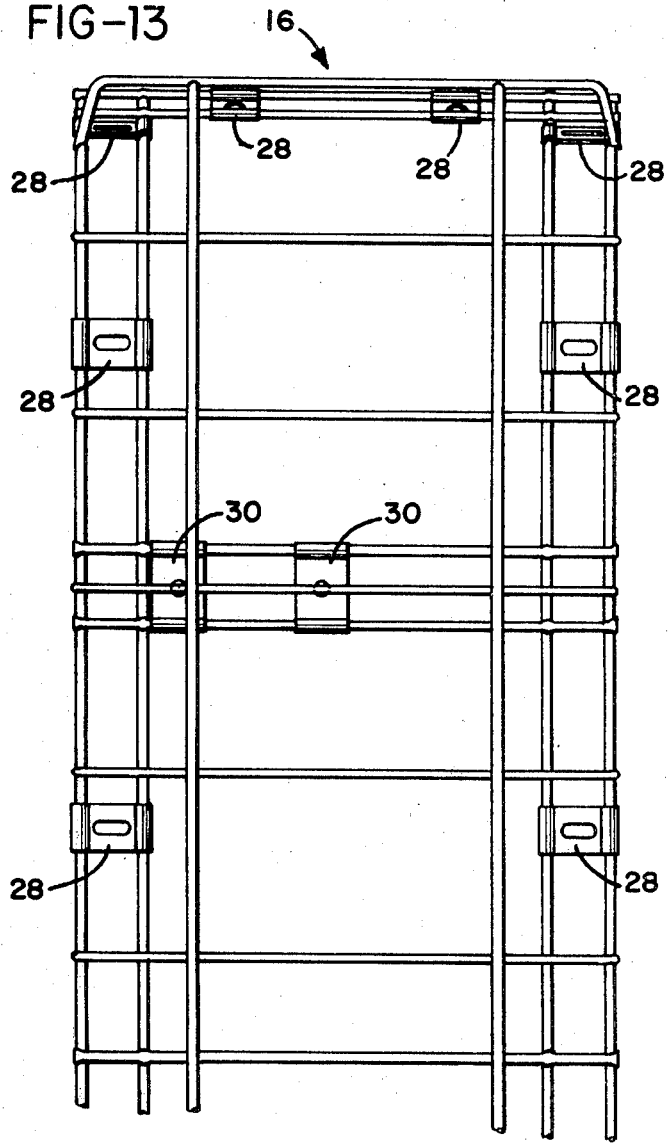
FIG. 13 is a partial plan view of the three-dimensional frame.

The three-dimensional frame of the present invention is shown in FIGS. 11–13. As seen best in FIG. 12, the frame includes a first outer wire mat 56 and a second inner wire mat 58, welded to the outer wire mat 56. As used herein, a "mat" comprises a mesh structure of crossing wires which are welded at their points of contact. The brackets 28 are provided on the border wires of the second inner wire mat 58 for engaging respective ones of the clips 22. It will be appreciated that by providing a multiple mat frame structure, the component is given its three-dimensional shape and, additionally, engagement of the frame 16 by the clips 22 is facilitated. If, for instance, only a single wire mat were to be provided, and the brackets 28 mounted on that wire mat, the frame engaging portions 50 of the clips 22 would protrude upward into contact with the substrate sheet 18. As shown in FIG. 5, however, by providing the multiple mat frame structure, the portion 50 can extend upward into the space between the mats without interference.

FIG. 14 illustrates another structural component assembly for upholstered furniture and wherein a wire frame 65 is constructed in a manner similar to the wire frame 16 described above in connection with FIGS. 11–13. The frame 65 includes an inner wire mat formed by crossing welded-together wires 66 and 67 and an outer wire mat including crossing welded-together wires 68 and 69. The side portions of the inner and outer wire mats are formed or bent downwardly to form the side portions 71 (FIGS. 14 and 15). The inner wire mat includes peripherally extending border wires 73 and 74 which extend generally parallel to the outer edges of the frame 65.

Upholstery means 80 is constructed as a sub-assembly in a manner similar to the upholstery means described above in connection with FIGS. 5–8 and includes a flexible or foldable substrate sheet 82 which is preferably formed of cardboard. Padding means 84, preferably in the form of resilient foam padding, is attached to the substrate sheet 82 by adhesive strips, and an upholstery material cover 86 overlays the padding 84. As mentioned above, the upholstery material cover 86 is commonly a decorative fabric material or a decorative vinyl material. The outer peripheral edge portions of the upholstery material cover 86 is secured or attached to the underlying edge portions of the substrate sheet 82 by stitching 88 which is performed on a suitable sewing machine after the padding 84 is confined between the material cover 86 and the substrate sheet 82.

In the embodiment of the invention illustrated in FIGS. 14–16, elongated clip members 90 are also attached to the outer edge portions of the substrate sheet 82 and cover 86 by the stitching 88, and each of the clip members is formed by extruding a thermoplastics material so that the clip member has a generally uniform wall thickness, for example, of approximately 0.050 inch. Referring to FIG. 20, each clip member 90 includes a longitudinally extending U-shaped snap portion 91 formed by arcuate inner wall sections 92 integrally connected by an arcuate outer wall section 94. The wall sections 92 and 94 define a longitudinally extending part-cylindrical recess 96 and extend circumferentially through an angle of approximately two hundred and seventy degrees. Each clip member 90 also includes a longitudinally extending flange portion 98 which projects laterally from one of the inner wall sections 92, and the stitching 88 attaches the flange portion 98 to the corresponding outer edge portion of the substrate sheet 82 and upholstery cover 86.

The U-shaped snap portion 91 of each clip member 90 has slight spring-like flexibility. Thus, after the upholstery means 80 is placed over the welded wire frame 65, the peripheral edge portions of the substrate sheet 82 and upholstery cover 86 are folded inwardly around the outer edges of the frame, and the clip members 90 snap-fit onto the border wires 73 and 74 on the wire frame 65, as illustrated in FIGS. 15 and 16. As a result of the positive over-center snap-fit connection of the clip members 90 with the border wires 73 and 74, the upholstery means is quickly and positively attached to the wire frame 65 with a generally uniform tension within the upholstery means around the periphery of the wire frame.

FIG. 17 shows a modified attachment of an upholstery material cover 106 to a wire frame 108 formed by crossing wires 109 and 111 welded together. The wire frame 108 is provided with a cylindrical border wire 112, and the upholstery material cover 106 is spaced from the wire frame 108 by foam padding 114 which is mounted directly on the wire frame. The outer edge portions of the upholstery material cover 106 are attached to corresponding border wires 116 (FIG. 20) of the wire frame 108 by means of the clip members 90 which are attached directly to the upholstery cover 106 by the stitching 88. The cover 106 is also attached to the border wire 112 by means of an elongated clip member 120 which is also extruded of a plastics material in the same manner as the clip member 90 but includes two outwardly projecting flange portions 122 integrally connected by a generally U-shaped snap portion 124. The snap portion 124 is extruded with the same cross-sectional configuration as the snap portion 91 of the clip member 90 so that the portion 124 snap-fits onto the border wire 112. The flange portions 122 of the clip member 120 are preferably stitched to the flexible cover 106 on opposite sides of the snap portion 124 so that the snap portion 124 forms a corner bead 128 within the upholstery material cover 106. The corner bead 128 is frequently desirable in upholstery furniture to provide a more attractive appearance.

Referring to FIG. 18, an upholstered piece of furniture is sometimes provided with one or more rigid trim members which may also be quickly and conveniently attached to a three-dimensional wire frame in accordance with the invention. For example, a wire frame 130 includes formed frame wires 132 welded to cross wires 134 which form border wires for the frame 130. A set of wood trim panels 135 are attached to the wire frame 130 by means of extruded plastic clip members 138. Each of the clip members 138 is extruded with a U-shaped snap portion 141 and a longitudinally extending flange portion 142 which projects tangentially or laterally from the outer wall section of the U-shaped snap portion 141. Th flange portion 142 of each clip member 138 is attached to its corresponding wood trim panel 135 by a layer of adhesive or cement 144. The border wires 134 are precisely located on the wire frame 130 by means of a fixture on the welding machine, and the clip members 138 are prelocated on each wood trim panel 135 by a fixture so that the sub-assembly of each trim panel 135 and corresponding attached clip members 138 may be easily and quickly assembled to the wire frame 130.

FIG. 19 illustrates another form of attaching upholstery means to a metal frame in accordance with the invention. As shown in FIG. 19, upholstery means 150, including a cardboard substrate sheet 152, foam padding 153 and a fabric or vinyl cover 154, are preassembled and attached to a sheet metal frame 156. A border wire 158 is welded to an inwardly projecting flange portion 159 of the sheet metal frame 156 around the periphery of the frame, and extruded plastic clip members 138 are stitched to the outer edge portions of the upholstery cover 154. The outer edge portions of the cover 154 are folded around the outer edge portions of the padding 153 and substrate sheet 152, and a layer 162 cement attaches each clip member 138 to the inner surface of the substrate sheet 152. The sub-assembly of the upholstery means 150 and the clip members 138 may be quickly and conveniently attached to the frame 156 simply by snap-fitting the clip members 138 onto the border wires 158. One application of the assembly illustrated in FIG. 19 is in connection with the mounting of an upholstered panel assembly onto the sheet metal door frame for a motor vehicle.

From the drawings and the above description, it is apparent that an upholstered component and its construction in accordance with the invention, provides desirable features and advantages. For example, by constructing the furniture component frame from welded cross wires in accordance with the invention and by attaching the upholstery means to the border wires on the wire frame in accordance with the invention, the cost of producing the furniture component and the weight of the component are significantly reduced while the strength, durability and stability of the component are increased. The attachment of the upholstery means to the border wires on the frame by means of the extruded plastic clip members as described in connection with FIGS. 14–20, also provides for economy in the manufacture of upholstered furniture. In addition, the clip members are flexible and provide for continuous attachment of the upholstery cover material around generally the entire periphery of the furniture component so that the attachment is not concentrated at localized points. This results in a more uniform tension in the upholstery material cover and reduces the chance of separating the cover from the frame or tearing the cover. The extruded plastic clip members may also be quickly and accurately stitched to the upholstery cover on a sewing machine and may be quickly attached to the border wires on the frame so that relatively unskilled people may produce upholstered furniture components having the attractive appearance previously produced by a professional with substantial training and experience in the production of upholstered furniture.

While the upholstered components and their methods of construction herein described constitute preferred embodiments of the invention, it is to be understood that the invention is not limited to these precise components and methods and that changes may be made in either without departing from the scope of the invention.

The invention having thus been described, the following is claimed:

1. A structural component assembly adapted for use in the production of upholstered furniture, said assembly comprising a frame having a substantially cylindrical attachment member, a layer of resilient padding material extending over said frame, a flexible outer cover material extending over said layer of padding material, an elongated clip member of extruded plastics material, said clip member including a longitudinally extending generally U-shaped snap portion defining a longitudinally extending recess for receiving said attachment member, said snap portion including wall sections extending more than one hundred eighty degrees around said attachment member and having parallel end surfaces projecting no further than a plane tangent to said attachment member, a longitudinally extending and substantially flat flange portion projecting laterally from one of said wall sections, means securing said flange portion to said cover material, said recess facing laterally relative to the plane of said flange portion, and said snap portion releasably snap-fits onto said attachment member for coupling said cover material to said frame.

2. A structural component assembly adapted for use in the production of upholstered furniture, said assembly comprising a wire frame having a cylindrical attachment wire, a layer of resilient padding material extending over said frame, a flexible outer cover material extending over said layer of padding material, an elongated clip member of extruded plastics material, said clip member including a longitudinally extending and generally U-shaped snap portion having wall sections defining a longitudinally extending recess for releasably receiving said attachment wire, said wall sections extending circumferentially more than one hundred eighty degrees around said attachment wire and having parallel end surfaces projection no further than a plane tangent to said attachment wire, said clip member having a longitudinally extending flange portion projecting laterally from one of said wall sections, said recess facing laterally relative to the plane of said flange portion and means attaching said flange portion to said cover material.

3. A clip member adapted for attaching an upholstery cover material to a generally cylindrical attachment member mounted on a frame, said clip member comprising an elongated flexible body of extruded plastics material, said body including a longitudinally extending snap portion having a generally U-shaped cross-sectional configuration, said snap portion having wall sections defining a longitudinally extending recess for receiving the attachment member and extending circumferentially around the member more than one hundred eighty degrees to form a snap-fit releasable connection with the member, said wall sections having parallel end surfaces projecting no further than a plane tangent to the attachment member, a longitudinally extending flange portion projecting laterally from one of said wall sections of said snap portion, said recess facing laterally relative to the plane of said flange portion, and said flange portion being adapted to be attached to the cover material.

4. An assembly as defined in claim 1 wherein said snap portion extends approximately two hundred seventy degrees around said attachment member.

5. An assembly as defined in claim 1 wherein said clip member has a substantially uniform wall thickness, and said flange portion is adapted to be stitched to said cover material with a sewing machine.

6. An assembly as defined in claim 1 and including a foldable substrate sheet disposed between said frame and said layer of padding material and having an outer edge portion, and said flange portion of said clip member is also secured to said edge portion of said substrate sheet.

7. An assembly as defined in claim 1 wherein said wall sections include opposing inner wall sections integrally connected by an outer wall section, and said flange portion projects laterally from one of said inner wall sections.

8. An assembly as defined in claim 7 and including a longitudinally extending second flange portion projecting laterally from the other said inner wall section of said snap portion.

9. An assembly as defined in claim 1 wherein said wall sections include opposing inner wall sections integrally connected by an outer wall section, and said flange portion projects laterally from said outer wall section.

10. An assembly as defined in claim 1 wherein said frame comprises a wire frame including a plurality of crossing wires welded together to form a wire mat, and said attachment member comprises a wire forming part of said wire mat.

11. An assembly as defined in claim 1 wherein said frame comprises a formed sheet metal panel, and said attachment member is attached to said panel.

12. An assembly as defined in claim 2 wherein said clip member has a generally uniform wall thickness, and said flange portion is adapted to be stitched to said cover material with a sewing machine.

13. An assembly as defined in claim 2 and including a foldable substrate sheet disposed between said frame and said layer of padding material and having an outer edge portion, and said flange portion of said clip member is also secured to said edge portion of said substrate sheet.

14. A clip member as defined in claim 3 wherein said snap portion extends circumferentially approximately two hundred seventy degrees relative to the attachment member.

15. A clip member as defined in claim 3 wherein said body has a substantially uniform wall thickness, and said flange portion is adapted to be stitched to the cover material with a sewing machine.

16. A clip member as defined in claim 3 wherein said wall sections include opposing inner wall sections integrally connected by an outer wall section, and said flange portion projects laterally from one of said inner wall sections.

17. A clip member as defined in claim 16 and including a longitudinally extending second flange portion projecting laterally from the other said inner wall section of said snap portion.

18. A clip member as defined in claim 3 wherein said wall sections include opposing inner wall sections integrally connected by an outer wall section, and said flange portion projects laterally from said outer wall section.

19. A clip member as defined in claim 18 in combination with a rigid trim panel attached to said flange portion to facilitate mounting said trim panel on said attachment member.

20. An assembly as defined in claim 1 wheerein said parallel and surfaces are disposed generally in the plane of said flange portion.

* * * * *